United States Patent [19]

Mercier

[11] Patent Number: 4,948,294

[45] Date of Patent: Aug. 14, 1990

[54] CONTROL DEVICE FOR UNDERGROUND DRAINAGE AND IRRIGATION NETWORK

[75] Inventor: François Mercier, Montréal, Canada

[73] Assignee: Innotag Inc., Montreal, Canada

[21] Appl. No.: 437,618

[22] Filed: Nov. 17, 1989

Related U.S. Application Data

[63] Continuation-in-part of Ser. No. 313,495, Feb. 22, 1989, Pat. No. 4,890,955.

[30] Foreign Application Priority Data

Feb. 22, 1988 [GB] United Kingdom ..... 8804009

[51] Int. Cl.[5] ..... E02B 11/00; E02B 13/00

[52] U.S. Cl. ..... 405/37; 405/36

[58] Field of Search ..... 405/36, 37, 39, 43, 405/45, 52, 38, 44, 47, 48; 137/236.1; 210/170

[56] References Cited

U.S. PATENT DOCUMENTS

| | | | |
|---|---|---|---|
| 585,856 | 7/1897 | Swanson | 405/37 |
| 888,217 | 5/1908 | Bishop | 405/37 |
| 1,018,251 | 2/1912 | McKee | 405/37 |
| 1,710,362 | 4/1929 | Korneff | 405/37 |
| 1,895,324 | 2/1932 | Heacock . | |
| 2,674,490 | 4/1954 | Richards | 405/37 X |
| 2,768,028 | 10/1956 | Robinson | 405/37 X |
| 3,204,872 | 9/1965 | Whear | 405/37 X |
| 3,368,355 | 11/1965 | Shroyer . | |
| 3,408,818 | 6/1966 | Hemphill . | |
| 3,559,408 | 2/1971 | Earnhart | 405/52 X |
| 4,180,348 | 12/1979 | Taylor . | |
| 4,268,993 | 5/1981 | Cunningham . | |
| 4,462,184 | 7/1984 | Cunningham . | |
| 4,538,377 | 9/1985 | Thornton | 405/39 X |
| 4,621,945 | 11/1986 | Shafer et al. | 405/37 X |
| 4,704,047 | 11/1987 | Oldfelt et al. . | |

FOREIGN PATENT DOCUMENTS

| | | | |
|---|---|---|---|
| 1088330 | 10/1980 | Canada . | |
| 0213964 | 9/1984 | German Democratic Rep. | 405/37 |
| 1006596 | 3/1983 | U.S.S.R. | 405/37 |
| 1035575 | 8/1983 | U.S.S.R. | 405/37 |
| 1194330 | 11/1985 | U.S.S.R. | 405/37 |

OTHER PUBLICATIONS

Smith et al., "Subirrigation System Control for Water Use Efficiency", Transactions of the ASAE, 1985, 489–496.

Fouss et al., "Weather Forecasts as a Control Input for Water Table Management in Coastal Areas", Transactions of the ASAE, Jan.–Feb. 1988, pp. 161–167, vol. 31(1).

Fouss et al., "Two-Stage Weir Control of Subsurface Drainage for Water Table Management", Transactions of the ASAE, Nov.–Dec. 1987, pp. 1713–1719, vol. 30(6).

Fouss et al., "PC Drainmod Predicts Performance of Sump-Controlled Water Table Management System", An ASAE Meeting Presentation, pp. 1–14.

*Primary Examiner*—Dennis L. Taylor

*Attorney, Agent, or Firm*—Cushman, Darby & Cushman

[57] ABSTRACT

The disclosure herein describes a control device for use with an underground drainage and irrigation network formed of a main conduit line and of adjacently disposed water permeable secondary conduit lines. At least one head control stand is used defining a water-collecting chamber with a pair of float members therein. These floats are operatively connected to respective drainage and irrigation control valves. The chamber communicates with an underground duct having a free, perforated end positioned between a pair of secondary lines to collect underground water received in the chamber to influence the floats. The valves are operated by the floats to maintain an underground water table between the two adjacent secondary lines at a level adequate for optimal plant growth.

19 Claims, 6 Drawing Sheets

CONTROL DEVICE FOR UNDERGROUND DRAINAGE AND IRRIGATION NETWORK

This application is a continuation-in-part of application Ser. No. 07/313,495, filed Feb. 22, 1989 now U.S. Pat. No. 4,890,955.

FIELD OF THE INVENTION

The present invention relates to a device for use with an underground drainage and irrigation network formed of a main conduit line and of adjacently disposed, water permeable secondary conduit lines with a view to controlling the underground water table level.

BACKGROUND OF THE INVENTION

In order to facilitate access to fields by heavy agricultural machinery during the spring and fall seasons, the ground of these fields is usually drained by an underground system. One widely used method consist in disposing drainage pipes made of plastic or other suitable material in the ground according to specific patterns. These pipes are usually buried at a depth of approximately 0,9 to 2 meters with a tilt angle between 0.01% and 2% and are spaced 10 to 50 meters apart.

When the flow of water in the drainage pipes is not controlled, it varies mainly as a function of the height of water directly above the pipes. Therefore, if the flow is not controlled after a given precipitation, the drainage system will evacuate water in the ground until the level of underground water reaches the level of the drainage pipes.

Many studies have shown that uncontrolled drainage systems cause dehydration of the soil during the crucial growing periods if no sufficient replenishment is provided by precipitations, such as rain. Indeed, since pipes are buried at a level lower than the level of water necessary for optimal plant (or crop) growth and since they drain the soil until the level of water is approximately equal to their level of burial, they are often prejudicial to such growth.

Numerous examples of drainage and/or irrigation control systems designed to overcome the above-mentioned problems exist. Some of them are found described in Canadian Pat. No. 1,088,330 and U.S. Pat. Nos. 4,621,945, 3,559,408 and 3,368,355. Some most Widely used control chambers are shown in U.S. Pat. Nos. 4,621,945 and 3,368,355.

However, these types of control chambers, while limiting the risks of excessive drainage, create a risk of underdrainage. Control chambers are usually adapted to drainage systems and are designed by taking into consideration fixed parameters, such as the hydraulic conductivity of the soil, the drainage coefficient, etc. When added to existing systems, the control chambers, whether of the "overflow" or "float" type, create a virtual drainage depth which is higher than the depth for which the system is designed. This situation can lead to the deterioration of crop since most roots are vulnerable to deprivation of oxygen by excessive water accumulation.

OBJECTS AND STATEMENT OF THE INVENTION

It is an object of the present invention to overcome the above-described problems associated with presently used control devices for underground drainage and/or irrigation systems. This is achieved by providing a control device for soil drainage and/or irrigation which takes into account the level of the underground water table between two drainage and/or irrigation conduit lines instead of that directly above these lines.

It is a further object of the present invention to provide a control device which is readily adaptable to existing drainage and/or irrigation systems, which is mechanically simple and which can be manufactured at a relatively low cost.

More specifically, in accordance with a first aspect of the invention, there is provided a control device for use with an underground irrigation network formed of a main conduit line and of adjacently disposed water permeable secondary conduit lines, comprising:

a head control stand means disposed at a predetermined location of the network, which stand means comprising a vertically extending housing defining a water-receiving chamber, water level sensing means being mounted in the chamber;

valve means associated with the stand means and mounted on a water supply pipe for supplying water to the network, the valve means being actuatable in response to the water level sensing means; and water table level measuring means disposed between two adjacent secondary conduit lines of the network, the measuring means being remotely associated with the water level sensing means in the stand means to open or close the valve means and thereby maintain an underground water table between the two adjacent lines at a level adequate for optimal plant growth.

Advantageously, the valve means are operatively connected to the sensing means in the chamber, the water table level measuring means is in fluid communication with the chamber, and these measuring means include water-collecting means having a water permeable section disposed between two adjacent secondary conduit lines of the network and water impermeable section connected to the chamber allowing underground water collected in the water permeable section to be received in the chamber to thereby influence the water level sensing means into operating the valve means to open or close and thereby maintain an underground water table between the two adjacent secondary conduit lines at a level adequate for optimal plant growth.

Preferably, the water-collecting means comprises an underground duct, the water permeable section comprises an end, perforated portion of the duct disposed between the two adjacent secondary conduit lines, and the water impermeable section comprises a non perforated portion of the duct interconnecting the perforated duct portion and the chamber.

According to another aspect of the present invention there is provided a control device for use with an underground drainage and irrigation network formed of a main conduit line and of adjacently disposed water permeable secondary conduit lines, comprising:

a head control stand means disposed at a predetermined location of the network, the stand means comprising at least one vertically extending housing defining a water-receiving chamber, water level sensing means being mounted in this chamber;

first drainage valve means mounted in the main line and associated with the stand means, the first valve means being operatively connected to the water level sensing means in the chamber;

second irrigation valve means associated with the stand means and mounted on a water supply pipe for supplying water to the network, the second valve means being also operatively connected to the water level sensing means in the chamber; and water table level measuring means in fluid communication with the chamber, the measuring means including water-collecting means having a water permeable section disposed between two adjacent secondary conduit lines of the network and a water impermeable section connected to the chamber allowing underground water collected in the water permeable section to be received in the chamber to thereby influence the water level sensing means into operating the first and second valve means to open or close and thereby maintain underground water table between the two adjacent water permeable secondary conduit lines at a level adequate for optimal plant growth.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DETAILED DESCRIPTION OF THE PREFERRED EMBODIMENTS

Figure 1:
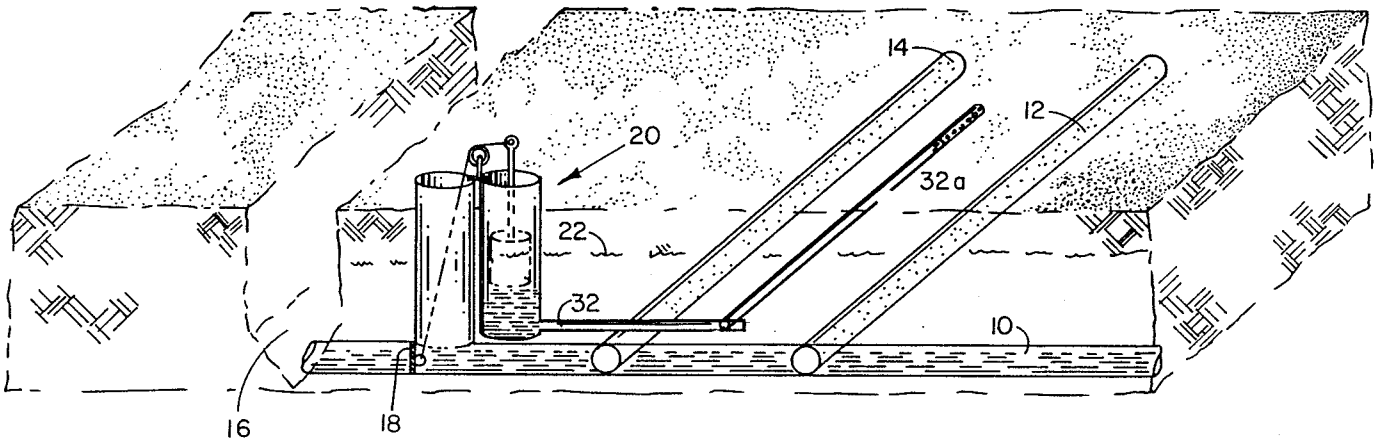
FIG. 1 is a perspective schematic view of an underground drainage network using a drainage control device made in accordance with the present invention.
Figure 2:
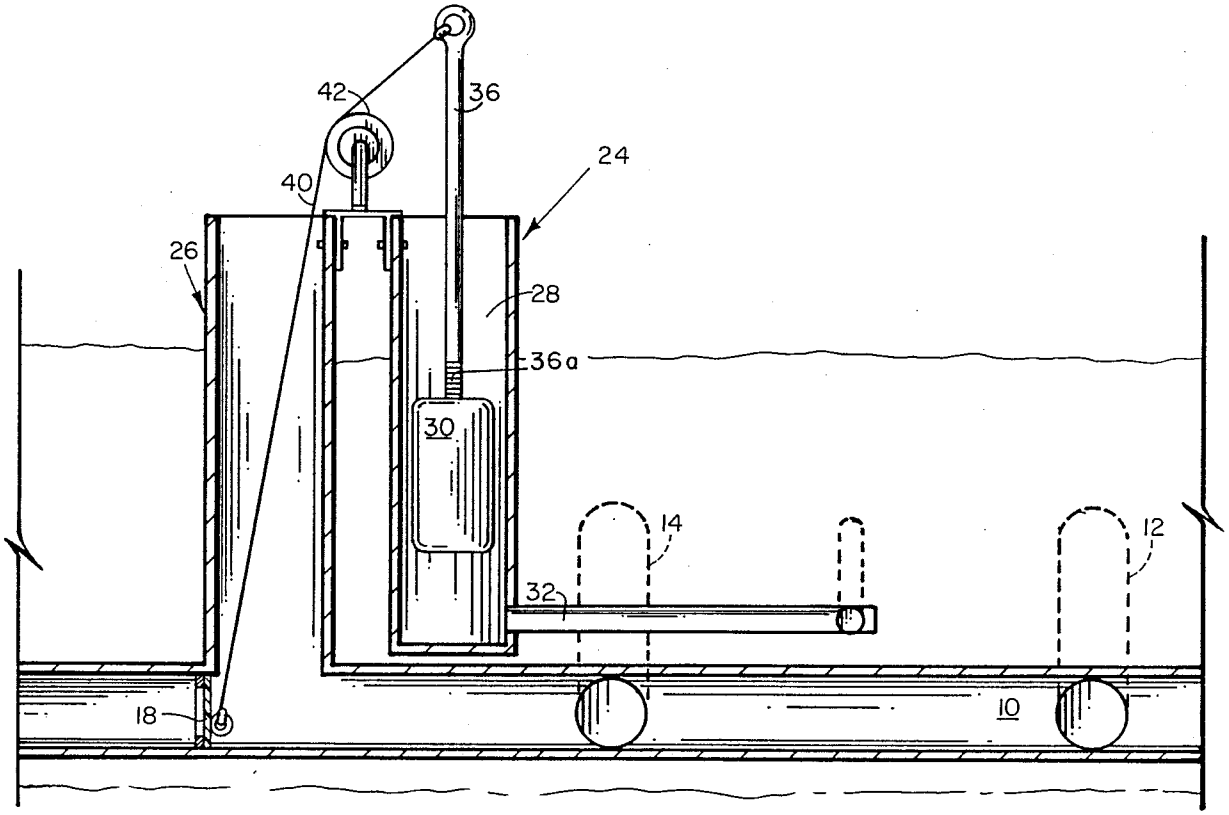
FIG. 2 is an elevational view of the drainage control device of FIG. 1.

Referring to FIGS. 1 and 2 of the appended drawings, there is shown a portion of an underground drainage and irrigation network that includes a main conduit line 10 and of two adjacently disposed secondary, inclined conduit lines 12 and 14 connected at one end thereof to the line 10. The lines 12 and 14 are parallel to each other, but they are perpendicular to the main line 10. The lines 10, 12 and 14 are advantageously made of plastic piping material, the plastic material of the conduit lines 10 and 12 being perforated to be water permeable.

For drainage purposes, water in the ground is collected by the perforated conduit lines 12 and 14 and is directed toward the main line 10. A valve in the form of a rubber door 18 is provided in the main line 10 allowing the water collected to be discharged, when desired, in a ditch 16.

A first aspect of the present invention is concerned with a means 20 for opening or closing the valve 18 to thereby control the water table level 22 and allow for optimal plant growth. An important feature of the present invention is that this water table level is measured between the two perforated lines 12 and 14 preferably at equidistance therefrom.

One form of such means 20 is illustrated in FIG. 2 and comprises a pair of hollow and vertically extending head control stands 24 and 26 arranged side-by-side. The drainage head control stand 24 consist of a chamber 28 in which a float 30 is provided. The lower part of the chamber has an opening to which is connected a duct 32 which is imperforated except in one area 32*a* (FIG. 1) situated equidistantly between lines 12 and 14.

The water collected in the perforated area 32*a* of the duct is conducted through gravity to the chamber 28 causing the float 30 to raise. It should be pointed out here that the level of water in the control stand 24 is function of the level 22 (FIG. 11 of the underground water table between the lines 12 and 14. In the embodiment illustrated, the float 30 is mounted on a shaft 36, the upper end of which is connected to the door 18 through a rope 40 itself mounted on a pulley 42.

The height of the float 30 within the stand 24 is adjustable. For example shaft 36 is provided with a threaded portion 36*a* allowing for this height adjustment.

When the water collected in the chamber 28 reaches a height causing the float 30 to raise, the upper end of the shaft 36 pulls the rope 40 to rotate the pulley 42 and open the door 18. The door 18 is opened until the water table returns to a desired level for optimal plant growth.

Figure 3:
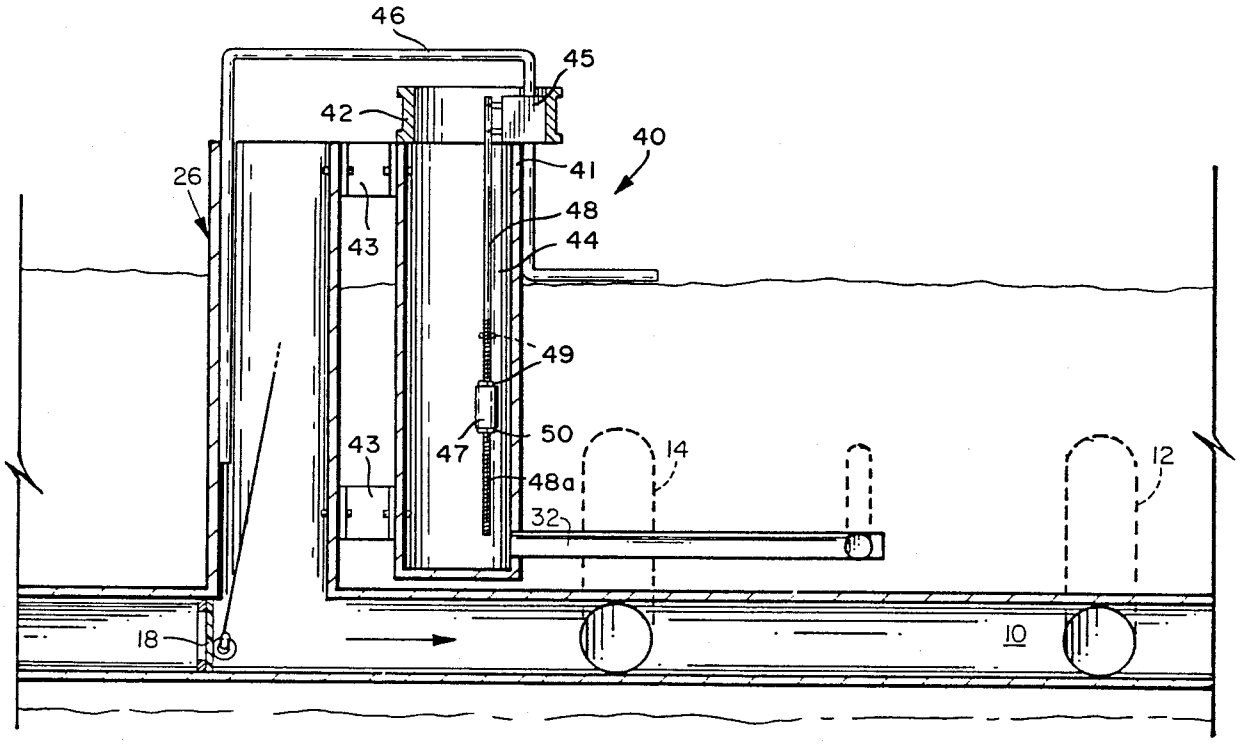
FIG. 3 is an elevational view of an irrigation control device in accordance with the present invention for use with the network of FIG. 1.

In FIGS. 1 and 2, a means 20 for opening or closing the valve 18 is illustrated. The means 20 can however be replaced, as shown in FIG. 3, by a means 40 for controlling irrigation of the ground through the underground lines 10, 12 and 14.

The means 40 again comprises the head control stand 26 communicating at the lower end thereof with the main line 10. It also comprises a hollow and vertically extending head control stand 41 attached to the stand 26 adjacent the latter (see brackets 43 in FIG. 3). The stand 41 consist of a chamber 44 having a lower opening connected to the duct 32 as explained above relative to stand 24 (FIG. 2).

An upper collar 42 is removably mounted on the stand 41, and a valve 45 is secured to the inside of collar 42. Valve 45 is mounted on a water supply pipe 46 and is operated by a float 47 responsive to the level of water in stand 41. For that purpose, float 47 is connected to the valve 45 through a metal rod 48 with its lower portion 48*a* threaded. The float 47 has a central hole to receive the threaded rod portion 48*a*. A pair of nuts 49 and 50 is engaged with the threaded rod portion 48*a*; nut 49 serves to close valve 45 while nut 50 serves to open valve 45. These nuts enable adjustment of the on and off positions of the float 47 along rod 48. When the nuts 49 and 50 both rest on either side of the float 47, valve 45 is operating in a modulating mode. The spacing between the nuts 49 and 50 can also be increased to operate valve 45 in a second range mode (see nut 49 illustrated in dashed lines in FIG. 3). In this second mode, the difference between the water levels in the stand 41 at which valve 45 is closed and opened is increased. Accordingly, the position of the nuts 49 and 50 on the threaded rod portion 48*a* can be easily adjusted in accordance with the requirements of the intended application.

As can be appreciated, the assembly including valve 45, rod 48 and float 47 can be removed from the stand 41 as the collar 42 is removed.

Figure 4:
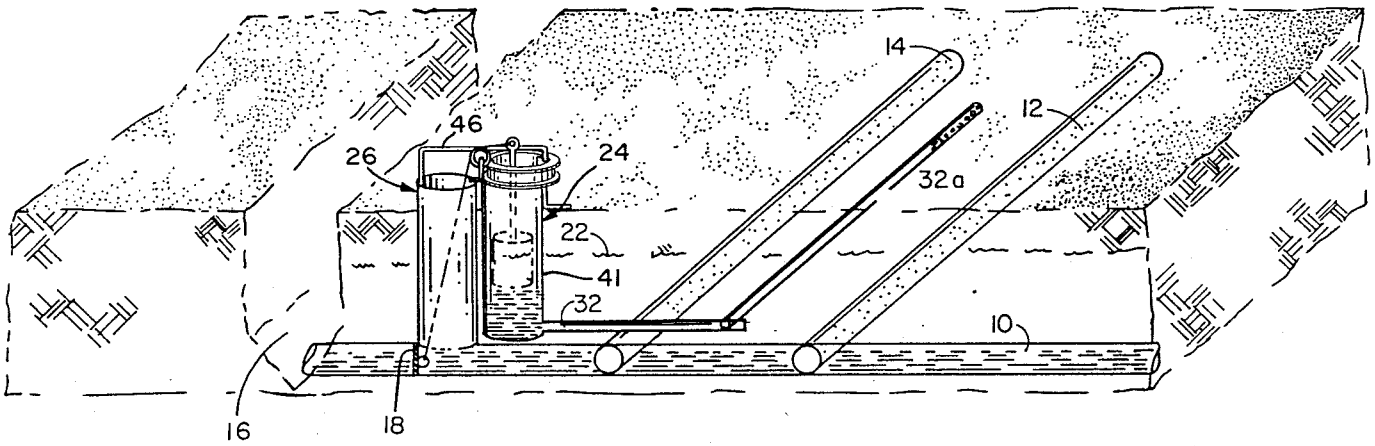
FIG. 4 is a perspective schematic view of an underground drainage and irrigation network using the drainage and irrigation control devices of FIGS. 2 and 3.

In an underground drainage and irrigation installation as illustrated in FIG. 4, both stands 24 and 41 are provided. Drainage and irrigation can then be simultaneously controlled. More specifically, valve 45 supplies water, for irrigation purposes, in the stand 26 through the pipe 46 in relation to the level of water detected by float 47 in control stand 41, while float 30 controls, for drainage purposes, opening of the door 18 in response to the level of water in stand 24. Again, the float 30 opens the door 18 through the shaft 36, pulley 42 and rope 40 passing through hollow stand 26.

Figure 5:
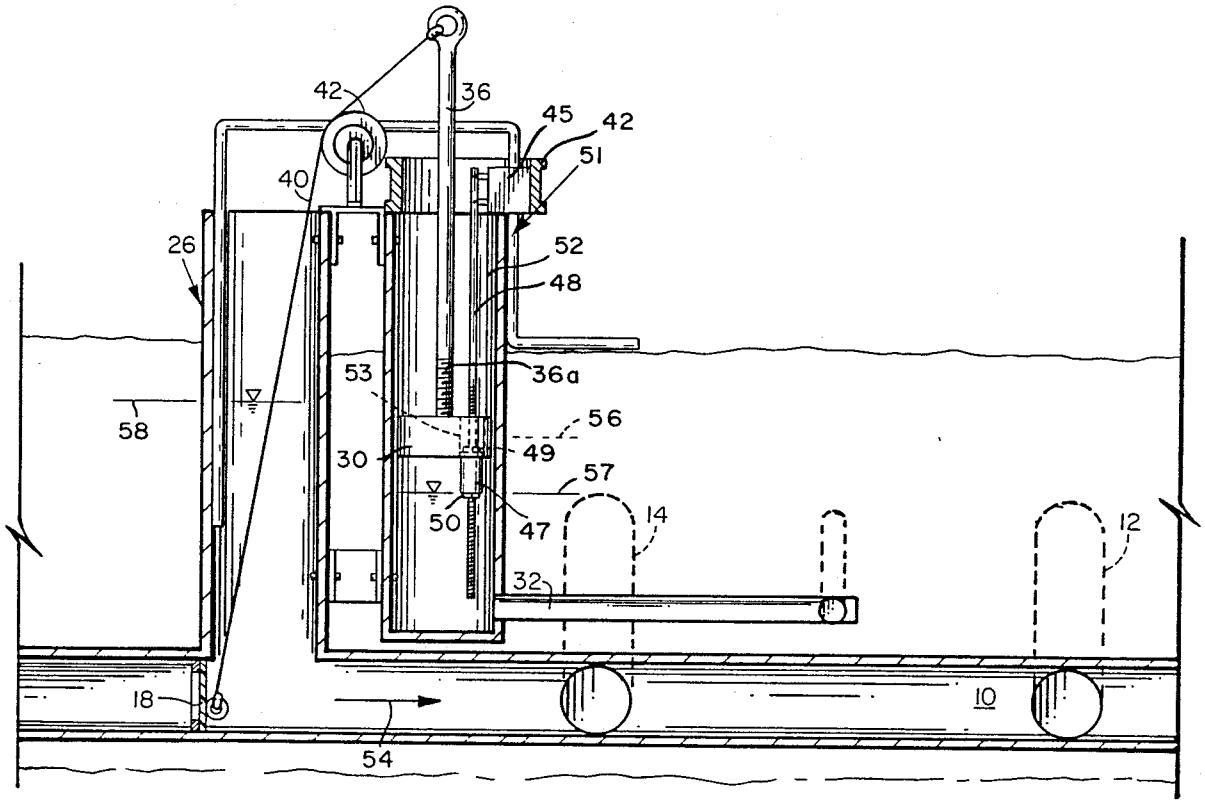
FIGS. 5 and 6 are elevational views of a drainage and irrigation device according to the invention for use with the underground network of FIG. 1.
Figure 6:
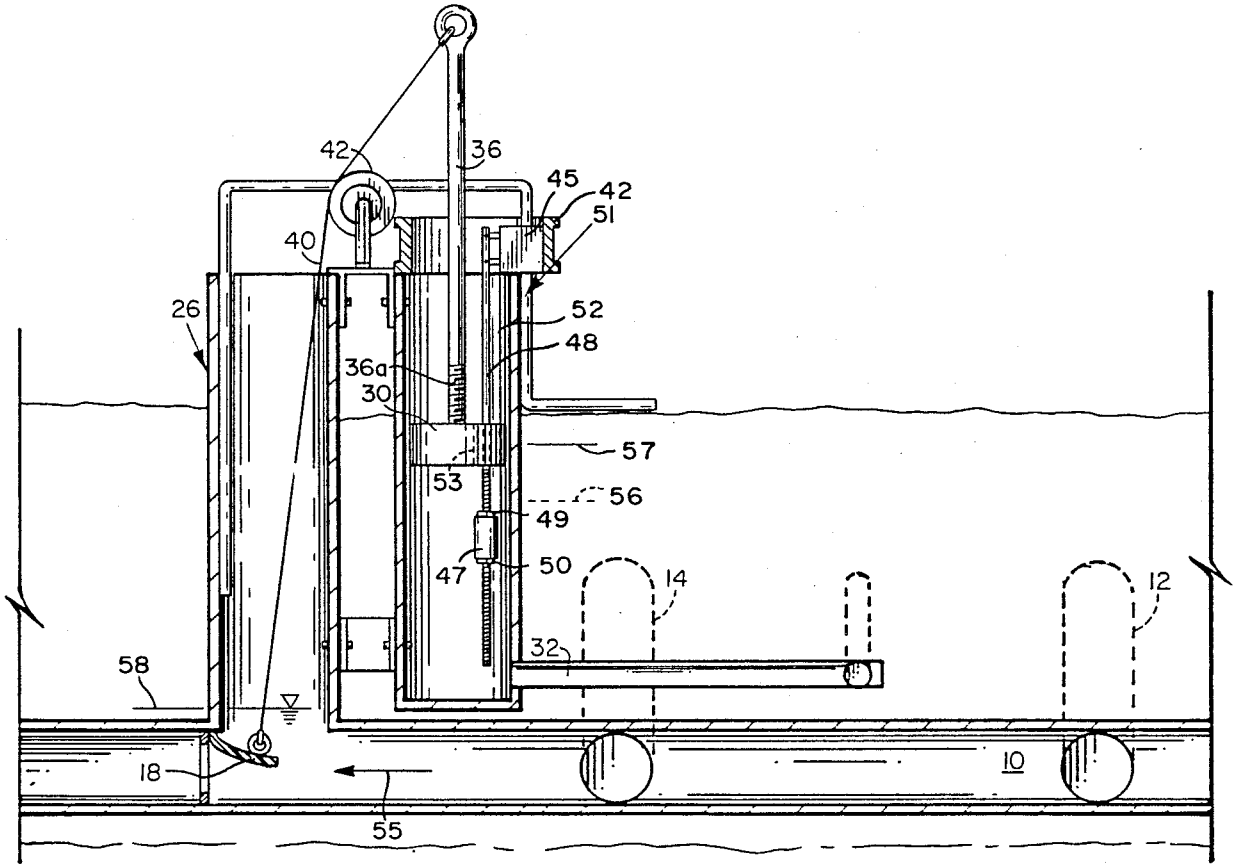
Figure 4:
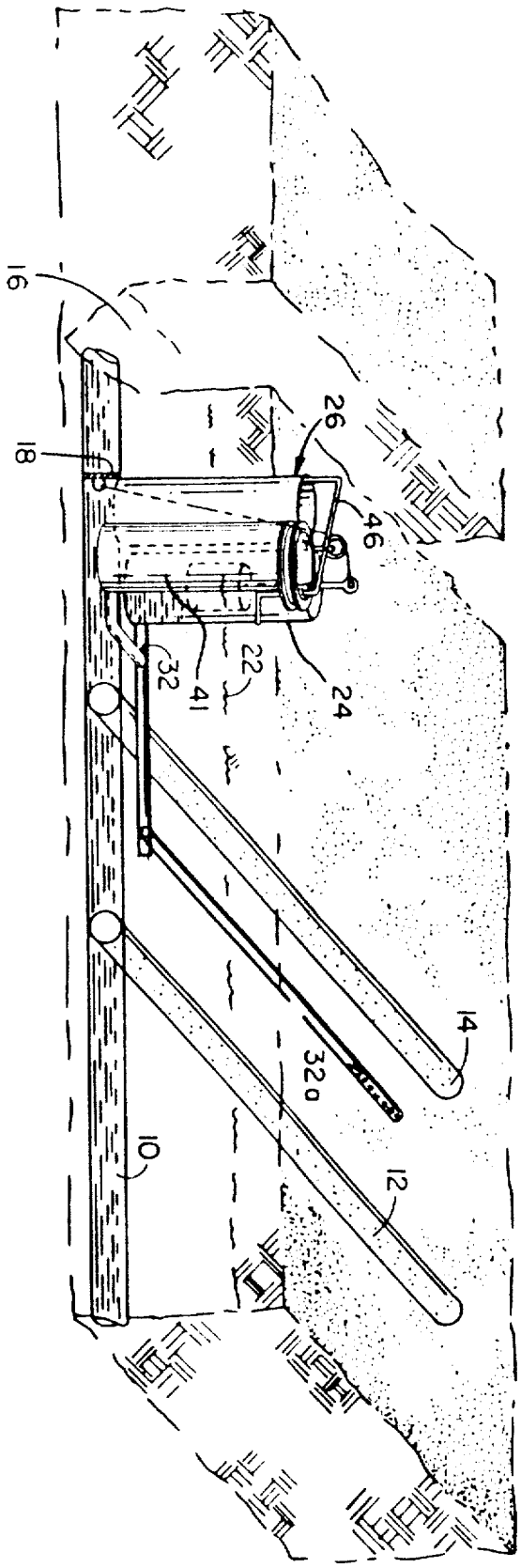

Also, as illustrated in FIGS. 5 and 6, the float 30, shaft 36, valve 45, rod 48 and float 47 can be placed on or in a single hollow and vertically extending control stand 51. Stand 51 consists of a chamber 52 with a lower opening connected to duct 32. In the latter embodiment, the float 30, positioned above float 47, is formed with a vertical opening 53 allowing passage of the rod 48 and float 47. Also, collar 42 may be formed with guiding means (not shown) in which the shaft 36 slides along the longitudinal, vertical axis of stand 51. Such guiding means are not required if the float 30 is elongated enough, as illustrated in FIG. 2, to resist to the lateral force produced by the rope 40.

As shown in FIG. 5, when the water in chamber 52 lowers under a first level door 18 is closed while valve 45 opens whereby the installation operates in the irrigation mode (see arrow 54 in FIG. 5). Referring now to FIG. 6, when the water in chamber 52 reaches a second level higher than the first one, valve 45 is closed while door 18 opens whereby the installation operates in the drainage mode (see arrow 55 in FIG. 6).

After valve 45 has opened, it closes when the water in chamber 52 reaches a third level higher than the first, lower one but lower than the second, higher one. The difference between the first and third levels depends on the type of the valve 45 but can also be adjusted through displacement of the nuts 49 and 50 along rod 48. In the same manner, the second, higher level can be adjusted through rotation of float 30 on the threaded portion **36*a* of shaft 36. After valve 45 has closed, water in the chamber 52 eventually reaches the second level to open the door 18, due to precipitations, in particular rain. The level of water in the chamber 52 is always located between the adjustable first and second levels whereby the underground water table between the lines 12 and 14** is adequate for optimal plant growth.

In FIGS. 5 and 6, 56 is a desired water table level in stand 51, 57 is the mid-spacing water table level measured through duct 32, and 58 is the water table level in stand 26.

Although the operation of the underground drainage and irrigation installation has been described hereinabove with reference to FIGS. 5 and 6, one skilled in the art can appreciate that the same operation can be obtained with an installation as proposed in FIG. 4, comprising two separate stands 24 and 41 to control drainage and irrigation, respectively, by appropriately adjusting the position of float 30 on shaft 36, and the position of nuts 49 and 50 along rod 48.

A basic system is illustrated in the appended drawings. Of course additional secondary water permeable conduit lines can be connected to main line 10, and the duct **32*a* can measure the underground water table between a plurality of different pairs of lines. Also many head control stand arrangements can be installed each provided with a duct 32** to measure the water table between a pair of underground conduit lines. In other words, the underground network and associated drainage and/or irrigation control devices can be expanded according to the requirements of the intended application.

More generally, although the present invention has been described hereinabove by way of preferred embodiments thereof, such embodiments can be modified at will, within the scope of the appended claims, without departing from the spirit and nature of the subject invention.

Alternatively, the door could be replaced by the use of a sump pump (not shown) which would be located in the control stand 26 and activated by a water level detecting device in the control stand 24 or elsewhere in the drained-irrigated field. Furthermore, the rope and pulley arrangement 40, 42 may be replaced by other valve operating means, such as gears, cams, multiple pulley, mechanical and/or hydraulic piston, or the like.

The embodiments of the invention in which an exclusive property or privilege is claimed are defined as follows:

1. A control device for use with an underground irrigation network formed of a main conduit line and of adjacently disposed water permeable secondary conduit lines, comprising:

a head control stand means disposed at a predetermined location of said network; said stand means comprising a vertically extending housing defining a water-receiving chamber; water level sensing means being mounted in said chamber;

valve means associated with said stand means and mounted on a water supply pipe for supplying water to said network, said valve means being actuatable in response to said water level sensing means; and water table level measuring means disposed between two adjacent secondary conduit lines of said network; said measuring means being remotely associated with said water level sensing means in said stand means to open or close said valve means and thereby maintain an underground water table between said two adjacent lines at a level adequate for optimal plant growth.

2. A control device for use with an underground irrigation network formed of a main conduit line and of adjacently disposed water permeable secondary conduit lines, comprising:

a head control stand means disposed at a predetermined location of said network; said stand means comprising a vertically extending housing defining a water-receiving chamber; water level sensing means being mounted in said chamber;

valve means associated with said stand means and mounted on a water supply pipe for supplying water to said network, said valve means being operatively connected to said sensing means in said chamber; and water table level measuring means in fluid communication with said chamber, said measuring means including water-collecting means having a water permeable section disposed between two adjacent secondary conduit lines of said network and a water impermeable section connected to said chamber allowing underground water collected in said water permeable section to be received in said chamber to thereby influence said water level sensing means into operating said valve means to open or close and thereby maintain an underground water table between said two adjacent secondary conduit lines at a level adequate for optimal plant growth.

3. The control device of claim 2, wherein said water-collecting means comprises an underground duct, said water permeable section comprises an end, perforated portion of said duct disposed between said two adjacent secondary conduit lines, and said water impermeable section comprises a non perforated portion of said duct interconnecting said perforated duct portion and said chamber.

4. The control device of claim 2, wherein said water level sensing means comprises a float disposed in said chamber.

5. The control device of claim 4, in which said float is connected to the valve means through a rod for opening and closing said valve means.

6. The control device of claim 5, further comprising means for adjusting the position of said float along the said rod.

7. The control device of claim 6, in which said float position adjusting means comprises:

said rod formed with a threaded portion;

said float formed with a hole traversed by said threaded portion of the rod; and two nuts engaged with the threaded portion of the rod on opposite sides of said float.

8. The control device of claim 7, wherein said two nuts are so positioned on the rod as to allow said float to slide along a given length of said rod.

9. The control device of claim 2, in which said stand means comprises a second vertically extending housing allowing supply of water to said network through said water supply pipe and valve means.

10. A control device as defined in claim 9, wherein said housings extend vertically in side-by-side parallel relationship.

11. A control device for use with an underground drainage and irrigation network formed of a main conduit line and of adjacently disposed water permeable secondary conduit lines, comprising:

a head control stand means disposed at a predetermined location of said network; said stand means comprising at least one vertically extending housing defining a water-receiving chamber; water level sensing means being mounted in said chamber;

drainage valve means mounted in said main line and associated with said stand means, said drainage valve means being operatively connected to said water level sensing means in said chamber;

irrigation valve means associated with said stand means and mounted on a water supply pipe for supplying water to said network, said irrigation valve means being also operatively connected to said water level sensing means in said chamber; and water table level measuring means in fluid communication with said chamber, said measuring means including water-collecting means having a water permeable section disposed between two adjacent secondary conduit lines of said network and a water impermeable section connected to said chamber allowing underground water collected in said water permeable section to be received in said chamber to thereby influence said water level sensing means into operating said drainage and irrigation valve means to open or close and thereby maintain an underground water table between said two adjacent water permeable secondary conduit lines at a level adequate for optimal plant growth.

12. The control device of claim 11, in which said water-collecting means comprises an underground duct, said water permeable section comprises an end, perforated portion of said duct disposed between said two adjacent secondary conduit lines, and said water impermeable section comprises a non perforated portion of said duct interconnecting said perforated duct portion and said chamber.

13. The control device of claim 11, in which said water level sensing means comprises first water level sensing means operatively connected to said first valve means, and second water level sensing means operatively connected to said irrigation valve means.

14. The control device of claim 13, in which:

said first water level sensing means comprises a first float in said chamber;

said second water level sensing means comprises a second float under said first float in said chamber, said second float being connected to said irrigation valve means through a generally vertical rod; and said first float comprises a passage therein for said generally vertical rod.

15. A control device as defined in claim 14, wherein said stand means comprises a second vertically extending housing enabling (a) connection between said first float and said drainage valve means, and (b) supply of water to said network by the water supply pipe and irrigation valve means.

16. A control device as defined in claim 15, wherein said housings extend vertically in side-by-side parallel relationship.

17. The control device of claim 13, wherein:

said stand means comprises first and second vertically extending housings defining first and second water-receiving chambers, respectively, said first and second chambers being both connected to said water impermeable section of said water-collecting means;

said first water level sensing means comprises a first float in said first chamber; and said second water level sensing means comprises a second float in said second chamber.

18. The control device of claim 17, wherein said stand means comprises a third vertically extending housing enabling (a) connection between said first float and said drainage valve means, and (b) supply of water to said network by the water supply pipe and irrigation valve means.

19. The control device of claim 18, wherein said housings extend vertically in side-by-side parallel relationship.

* * * * *

UNITED STATES PATENT AND TRADEMARK OFFICE

CERTIFICATE OF CORRECTION

PATENT NO. : 4,948,294

DATED : August 14, 1990

INVENTOR(S) : Francois Mercier

It is certified that error appears in the above-identified patent and that said Letters Patent is hereby corrected as shown below:

In the drawings

Fig. 4, should be deleted to be replaced with Fig. 4, as shown on the attached sheet.

Signed and Sealed this

Twenty-second Day of September, 1992

*Attest:*

DOUGLAS B. COMER

*Attesting Officer*

*Acting Commissioner of Patents and Trademarks*